US005182128A

United States Patent [19]

Laplace

[11] Patent Number: 5,182,128

[45] Date of Patent: Jan. 26, 1993

[54] METHOD AND APPARATUS FOR PRODUCING A WRAPPED FOOD MATERIAL IN SINGLE SLICE FORM

[75] Inventor: Christian Laplace, Quebec, Canada

[73] Assignee: Kraft General Foods Canada Inc., Don Mills, Canada

[21] Appl. No.: 667,838

[22] Filed: Mar. 12, 1991

[51] Int. Cl.[5] ..... B65B 3/00; B65B 11/00

[52] U.S. Cl. ..... 426/410; 53/451; 53/552; 83/402; 426/130; 426/414

[58] Field of Search ..... 426/410, 414, 130; 53/551, 552, 451; 83/402

[56] References Cited

U.S. PATENT DOCUMENTS

| | | | |
|---|---|---|---|
| 2,432,373 | 12/1947 | Bleam et al. | 53/541 |
| 2,559,700 | 7/1951 | Bauer | 83/402 |
| 3,086,335 | 4/1963 | Frank | 53/551 |
| 3,542,570 | 11/1970 | Bush et al. | 53/451 |
| 3,544,340 | 11/1970 | Miller et al. | 426/410 |
| 3,753,331 | 8/1973 | Sato | 53/374.9 |
| 3,869,843 | 3/1975 | Darrah, III et al. | 53/473 |
| 3,976,237 | 8/1976 | Bossoms | 83/402 |
| 4,007,577 | 2/1977 | Matthews et al. | 53/570 |
| 4,009,551 | 3/1977 | Greenawalt et al. | 53/451 |
| 4,015,021 | 3/1977 | Harima et al. | 426/414 |
| 4,040,237 | 8/1977 | O'Brien | 53/551 |
| 4,043,098 | 8/1977 | Putnam, Jr. et al. | 53/551 |
| 4,108,711 | 8/1978 | Hoffmann | 83/402 |
| 4,118,913 | 10/1978 | Putnam, Jr. et al. | 53/551 |
| 4,666,723 | 5/1987 | Invernizzi et al. | 426/414 |

FOREIGN PATENT DOCUMENTS

| | | | |
|---|---|---|---|
| 759533 | 10/1956 | United Kingdom | 83/402 |

*Primary Examiner*—Steven Weinstein
*Assistant Examiner*—Jean L. Aberle
*Attorney, Agent, or Firm*—Linn I. Grim

[57] ABSTRACT

A method and apparatus for producing a wrapped food material in single slice form. The apparatus comprises means to conduct the food material into a wrapping film to form a wrapped food material, a slice forming assembly to press the wrapped food material at spaced intervals to form a continuous strip of connected, wrapped food material slices, and a cutting assembly to cut that continuous strip at the spaced intervals to produce individually wrapped and sealed food material slices. The apparatus also includes a guide plate to guide the continuous strip of wrapped food material slices from the slice forming assembly to the cutting assembly along a predetermined path of travel; a partial vacuum is developed between the continuous strip of wrapped food material slices and at least a portion of the guide plate to draw that strip thereagainst as the strip of connected slices passes to the cutting assembly.

9 Claims, 2 Drawing Sheets

METHOD AND APPARATUS FOR PRODUCING A WRAPPED FOOD MATERIAL IN SINGLE SLICE FORM

BACKGROUND OF THE INVENTION

This invention generally relates to methods and apparatus for packaging food materials in the form of individually wrapped single slices; and more specifically, to such a method and apparatus having an improved arrangement for guiding a continuous strip of wrapped food material to a cutting assembly that cuts that continuous strip into individually wrapped single slices.

Various food materials, particularly cheeses, are sold in packages containing individually wrapped single slices of the food material, and various prior art methods and apparatuses are known for preparing food materials in this form. Typically, with these prior art arrangements, as exemplified in U.S. Pat. No. 4,015,021, a food material is extruded into a continuous envelope or tube of wrapping film to form a wrapped food material, that wrapped food material is then flattened into a continuous strip, and this continuous strip is pressed at spaced intervals to express the food material from between those spaced intervals, thereby establishing wrapped food material slices of a predetermined length. The continuous strip of wrapped slices is then cut to produce individually wrapped slices of the food material.

While these prior art methods and apparatuses perform very satisfactorily, it is believed that they may be improved. For instance, in these prior art methods and apparatuses, typically the continuous strip of wrapped food material is loosely fed to the assembly that cuts that strip into the individual pieces. Because of this, the continuous strip is not always properly fed to the cutting assembly, particular upon the initial feeding of the strip to the cutting assembly. Also, the continuous strip of wrapped food material sometimes becomes blocked in its passage through the cutting assembly.

SUMMARY OF THE INVENTION

The present invention relates to a method and apparatus for producing a wrapped food material in single slice form. The apparatus comprises means to conduct the food material into a wrapping film to form a wrapped food material, slice forming means to press the wrapped food material at spaced intervals to form a continuous strip of connected, wrapped food material slices, and cutting means to cut that continuous strip at those spaced intervals to produce individually wrapped and sealed food material slices. The apparatus also includes means to guide the continuous strip of wrapped food material slices from the slice forming means to the cutting means along a predetermined path of travel. This guiding means, in turn, includes a guide plate located between the slice forming means and the cutting means, and extending along said path of travel, and means to develop a partial vacuum between the continuous strip of wrapped food material slices and at least a portion of the guide plate to draw that strip thereagainst as the strip of connected slices passes to the cutting means.

Preferably, a venturi effect is used to develop the desired partial vacuum between the continuous strip of the wrapped food material and the guide plate. More specifically, this vacuum is developed by conducting a first stream of air laterally outward in a first direction from a given area of the guide plate and conducting a second stream of air laterally outward in a second direction from that same given area of the guide plate. These two air streams thus produce a partial vacuum between the continuous strip of wrapped food material slices and that given area of the guide plate.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
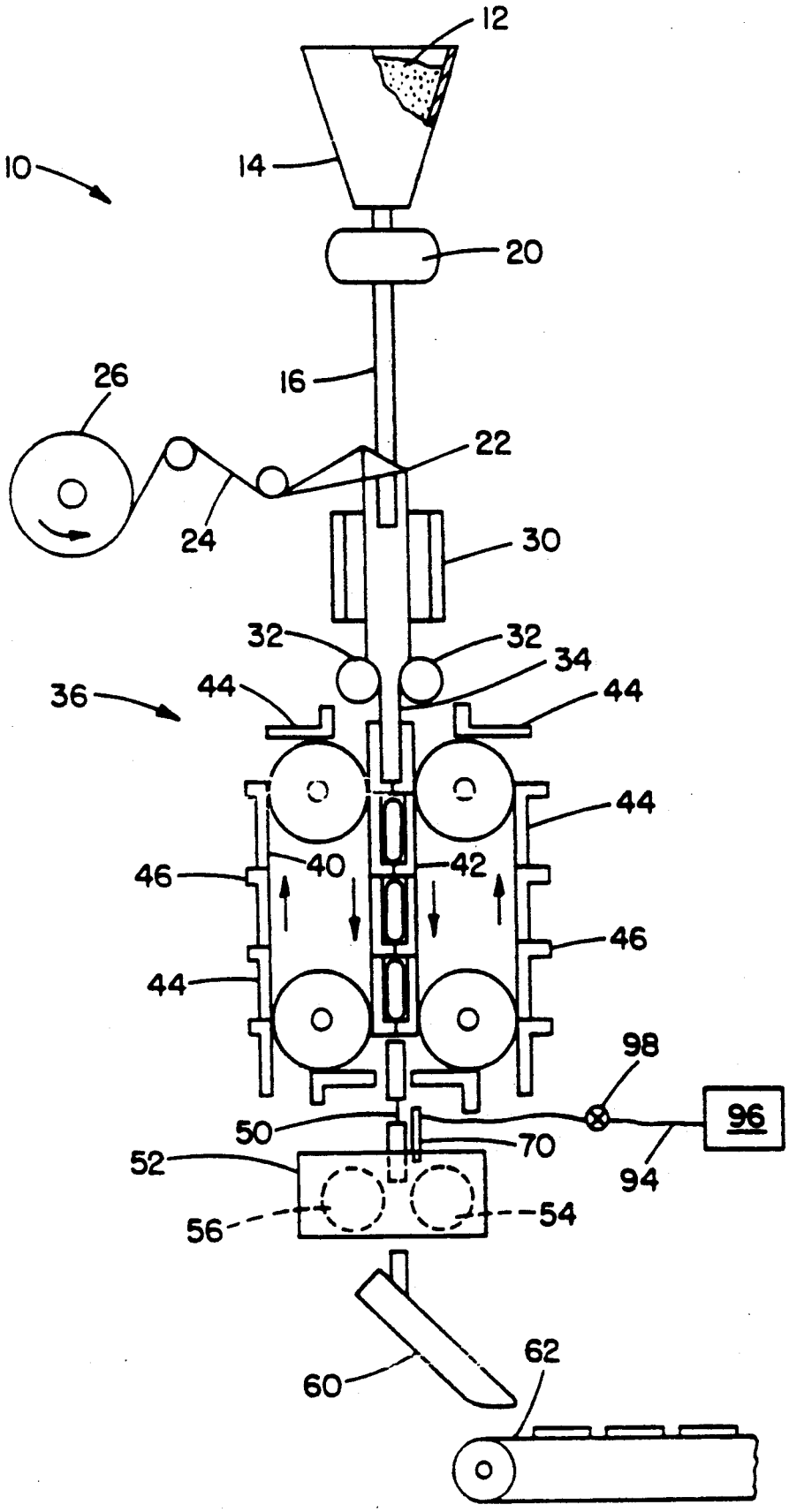
FIG. 1 is a schematic, side elevation view of an apparatus embodying the present invention.

FIG. 1 illustrates a preferred food processing apparatus 10 employing teachings of this invention. A food material 12, which may be fluid or semi-fluid, such as processed cheese or cheese foods, is placed into a hopper 14 and continuously fed to a nozzle 16 by means of a pump 20. The nozzle is inserted into a tube of wrapping film 22, which has been formed from a strip 24 mounted on a film holder 26, and a cooling assembly 30 is provided to cool the food material discharged from nozzle 16.

The tubular film 22 filled with the food material 12 is then fed between press rolls 32 that press the food material into a strip form 34 in which the food material is in intimate contact with the inner surface of the film. The rolls 32 serve not only to reduce the wrapped food material to a strip form but also to transport the formed strip. After leaving rolls 32, the food material strip 34 is then press molded to the desired shape by means of a molding device 36, which comprises a pair of moving belts 40 and 42 and a multitude of molding frames 44 mounted on each of those belts.

The inner runs of belts 40 and 42 are arranged in opposing relation to each other so that a pair of molding frames, one on belt 40 and one on belt 42, come into matching contact between the inner runs of the belts. Each of the molding frames has a projecting wall portion 46 that extends horizontally when the frame is moving vertically between the inner runs of the belt, and the outer most ends of the projecting wall portions of opposing molding frames come into matching contact between the inner runs of belts 40 and 42 to press strip 34 at regular, spaced intervals. This forms connecting sections 50 on strip 34 and also squeezes the food material out of those connecting sections to form slices of the food material.

Strip 34 then is conducted to cutting apparatus 52, which comprises anvil 54 and rotary cutter 56. The rotary cutter slices the strip 34 along connecting sections 50, producing individual slices of wrapped food material. These individually cut, wrapped food material single slices are fed, one after another, onto a delivery conveyor 62 and thereafter a stacking wheel (not shown) is used to stack the slices in a pile.

Guide plate 70 is located between assembly 36 and cutting assembly 52 to guide strip 34 into that latter assembly, and a partial vacuum is developed between the food material strip and at least a portion of plate 70 to draw that strip thereagainst as the strip of food material passes into the cutting assembly. In this way, plate 70 positively guides the strip 34 into cutting assembly 52, between anvil 54 and rotary knife 56, insuring that the strip of food material properly enters and passes smoothly through that cutting apparatus.

Any suitable means or system may be used to produce the desired partial vacuum between strip 34 and guide plate 70; however, preferably, a venturi effect is used to generate the desired vacuum. Even more preferably, this venturi effect is produced by directing first and second streams of air laterally outward in first and second opposite directions from a given area of guide plate 70, thereby producing a partial vacuum between food strip 34 and that given area of the guide plate.

As described above, apparatus 10 produces one strip 34 of food material. With modifications well within the ability of those of ordinary skill in the art, apparatus 10 may be constructed and operated to produce two or more such strips in parallel; and, indeed, the preferred embodiment of guide plate 70 described below in detail is designed to guide two parallel strips of food material from assembly 36 to cutting assembly 52.

Figure 2:
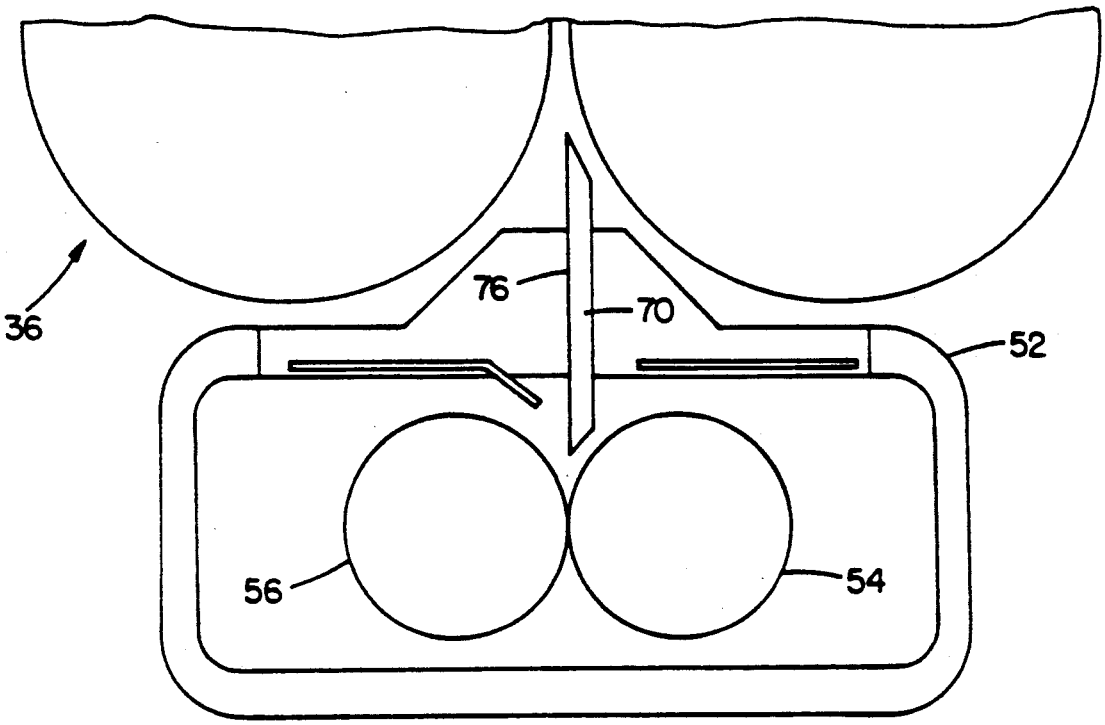
FIG. 2 shows in greater detail a portion of the apparatus of FIG. 1.
Figure 3:
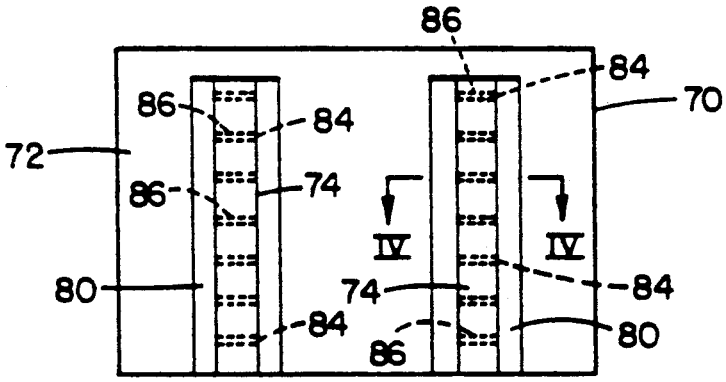
FIG. 3 is a plan view of a guide plate used in the apparatus of FIG. 1.
Figure 4:
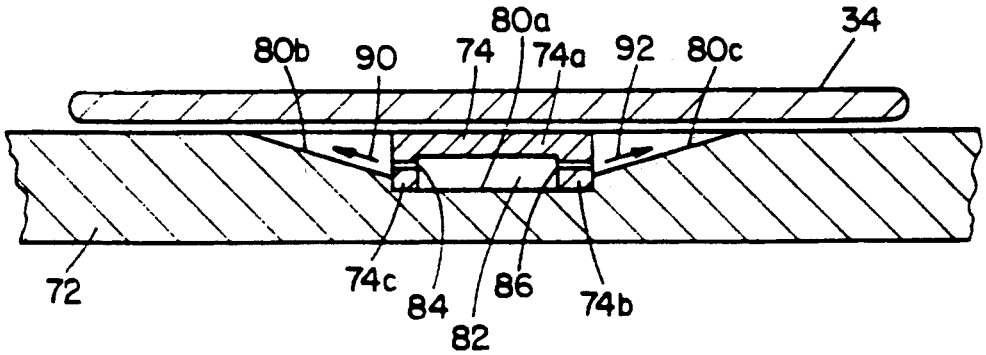
FIG. 4 is a cross-sectional view taken along Line IV—IV of FIG. 3.

Guide plate 70 is illustrated in greater detail in FIGS. 2–4; and with reference thereto, the guide plate preferably includes a base member 72 and a pair of discharge manifolds 74. Base member 72 defines a preferably planar guide surface 76 and a pair of grooves or recesses 80. These grooves extend inward from that guide surface, and in apparatus 10, grooves 80 extend along the direction of travel of food strip 34. Each discharge manifold 74 is positioned in a respective one groove 80 and forms a longitudinally extending conduit 82 and first and second series of transverse outlet openings 84 and 86. In use, high-pressure air is conducted into conduit 82, openings 84 conduct a first air stream, referenced at 90 in FIG. 4, outward from conduit 82 and toward the first transverse side of plate 70, and openings 86 conduct a second air stream, referenced at 92 in FIG. 4, outward from conduit 82 and toward the second transverse side of the guide plate. These air streams produce the above-discussed venturi effect, which in turn produces a low pressure region, or partial vacuum, between food strip 34 and the portion of guide plate 70 between these air streams.

As illustrated in FIGS. 3 and 4, each discharge manifold 74 has a U-shaped transverse cross-section, and includes base portion 74*a* and first and second leg portions 74*b* and 74*c*, which extend outward from the transverse ends of base portion 74*a*, perpendicular thereto. Openings 84 are formed in leg portion 74*b* and preferably are equally spaced apart along the length of this leg portion; and similarly, openings 86 are formed in leg portion 74*c* and preferably are equally spaced apart along the length of this leg portion.

With particular reference to FIG. 4, each groove 80 preferably is formed by a central surface portion 80*a* and a pair of lateral surface portions 80*b* and 80*c*. Each discharge manifold 74 is positioned immediately over the central surface portion of a respective one groove 80; and the lateral surface portions 80*b* and 80*c* of each groove extend laterally outwardly upwardly in first and second opposite directions, respectively, from the central surface portion of the groove to help guide the first and second air streams outward from the discharge manifold positioned in the groove.

Any suitable means may be used to conduct air to guide plate 70, and in particular, into conduits 82 thereof. For example, with the arrangement shown in FIG. 1, a hose or air line 94 is used to conduct pressurized air from a source thereof 96 and into one end of each conduit 82. Alternatively, for example, openings (not shown) may be formed through base member 72 extending outward from and in fluid communication with each conduit 82, and a hose or air line may be secured in each of these openings to conduct pressurized air from a source thereof and into conduits 82, between the longitudinal ends thereof.

Preferably, control means are provided to control the volume of air in the air streams 90 and 92, and this may be done by controlling the amount of air supplied to conduits 82. With the embodiment of apparatus 10 shown in FIG. 1, this control means includes a valve 98 disposed in line 94 and which is operated, either manually or automatically, to adjust the volume of air conducted through line 94 and, thereby, to adjust the venturi effect produced by air streams 90 and 92.

Guide plate 70 has a generally flat, thin shape, although preferably the top and bottom ends of the plate are slanted, as shown in FIG. 2, to facilitate positioning that plate between assemblies 36 and 52. Plate 70 may be made of any suitable material, such as steel. Preferably, however, plate 70, or at least surface 76 thereof, is comprised of chromium or a chromium alloy to reduce the friction between the guide plate and food strip 34. The guide plate 70 may be supported in assembly 10 in any acceptable manner; and for example, this plate may be connected to and supported by cutting assembly 52. Also, manifold members 74 may be secured to base member 72 in any suitable manner. For example, a suitable friction fit may be developed between manifold member and base member to hold the manifold member in place in one of the grooves 80. Alternatively, for example, the manifold members may be bolted or welded to the base member.

Hopper 14, nozzle 16, pump 20, film 24, sealing assembly 30, rolls 32, molding assembly 36, and cutting assembly 52 may all be comprised of standard or known items in the art, and it is unnecessary to describe these elements of apparatus 10 herein in detail. Further, each molding frame 44 may be provided with a press plate (not shown) of the type known in the art to press against the top surface of the food material in strip 34 to produce slices having a uniform thickness and an exact shape.

In addition, various items may be added to apparatus 10 without departing from the scope of the present invention; and in particular, additional cooling means, heating means, or both may be added at various locations in apparatus 10 to control the temperature of the wrapped food material moving therethrough. Further, the embodiment of apparatus 10 shown in FIG. 1 uses a nozzle 16 having a circular shaped outlet. Instead of using such a nozzle, apparatus 10 may be provided with a nozzle having a narrow, slit-shaped outlet; and when such a nozzle is used, it may be unnecessary to use press rolls 32 to flatten the food material discharged from the nozzle. In addition, apparatus 10 may be provided with a sealing assembly to form a sealed seam on the wrapping film after that film has been filled with food material. Also, other cutting devices may be used in apparatus 10; and, for example, this apparatus may be provided with a rotary heat cutter that cuts connecting sections 50 of strip 34 by melting those areas of the food strip.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. Apparatus for producing a wrapped food material in single slice form, comprising:

means to conduct the food material into a wrapping film to form a wrapped food material;

slice forming means to press the wrapped food material at spaced intervals to form a continuous strip of connected, wrapped food material slices cutting means to cut said continuous strip at said spaced intervals to produce individually wrapped and sealed food material slices; and means to guide said continuous strip from the slice forming means to the cutting means along a predetermined path of travel, and including i) a guide plate located between the slice forming means and the cutting means, and extending along said path of travel, and ii) means connected to the plate to develop a partial vacuum between said continuous strip and at least a portion of the guide plate to draw said strip thereagainst as the strip of connected slices passes to the cutting means, said guide plate having first and second opposite transverse sides, a guide surface for said strip and including a base member forming a groove extending inward from the guide surface, means located in the groove to conduct a first stream of air laterally outward from said groove and towards the first transverse side of the guide plate, and to conduct a second stream of air laterally outward from the groove and towards the second transverse side of the guide plate, said first and second streams of air producing a partial vacuum between a portion of the guide surface and the continuous strip of wrapped food material slices, said means to develop a partial vacuum including means to conduct pressurized air to said groove from a source of pressurized air.

2. Apparatus according to claim 1, wherein: the means to conduct the first and second streams of air outward from said groove includes a discharge manifold located in the groove; and the discharge manifold defines i) a conduit for receiving the pressurized air, ii) a first series of openings to conduct pressurized air outward from said conduit and towards the first transverse side of the guide plate, and iii) a second series of openings to conduct pressurized air outward from said conduit and towards the second transverse side of the guide plate.

3. Apparatus according to claim 2, wherein:

the discharge manifold includes i) a base portion, ii) a first leg portion connected to and extending from the base portion, and iii) a second leg portion connected to and extending from the base portion; and the first series of openings are formed in the first leg portion of the discharge manifold, and the second series of openings are formed in the second leg portion of the discharge manifold.

4. Apparatus according to claim 3, wherein the base member of the guide plate includes a central surface section spaced inward from the guide surface;

the manifold extends over said central surface section;

the base member of the guide plate further includes i) a first lateral surface portion extending laterally outwardly upwardly from the central surface section to guide the first air stream outward from the first series of openings, and ii) a second lateral surface portion extending laterally outwardly upwardly from the central surface section to guide the second air stream outward from the second series of openings.

5. Apparatus according to claim 2, wherein the means to conduct pressurized air to said groove includes a fluid line to conduct pressurized air into the conduit of the discharge manifold from the source of pressurized air.

6. Apparatus according to claim 2, wherein the means to develop the partial vacuum further includes valve means connected to the fluid line to control the volume of air conducted therethrough.

7. A method for producing a wrapped food material in single slice form, comprising:

conducting the food material into a wrapping film to form a wrapped food material;

pressing the wrapped food material at spaced intervals to form a continuous strip of connected, wrapped food material slices;

conducting said continuous strip along a predetermined path of travel to a cutting apparatus, including i) conducting the continuous strip past a guide plate extending along said path of travel, and ii) developing a partial vacuum between the continuous strip and the guide plate to draw the continuous strip thereagainst; said developing step including:

conducting a first steam of air laterally outward in a first direction from a given area of the guide plate; and conducting a second stream of air laterally outward in a second direction from said given area of the guide plate; wherein said first and second streams of air produce a partial vacuum between the continuous strip of food material slices and said given area of the guide plate; and using the cutting apparatus to cut the continuous strip at said spaced intervals to produce individually wrapped food material slices.

8. A method according to claim 7, wherein the developing step further includes the step of controlling the volume of air in said first and second streams.

9. A method according to claim 7, wherein the guide plate includes a body member and a manifold connected to the body member, and wherein:

the developing step further includes the step of conducting a supply of air from a source thereof to the manifold;

the step of conducting the first stream of air includes the step of discharging the first stream of air laterally outward from a first side of the manifold; and the step of conducting the second stream of air includes the step of discharging the second stream of air laterally outward from a second side of the manifold.

* * * * *